US005094658A

United States Patent [19]

Smithe et al.

[11] Patent Number: 5,094,658

[45] Date of Patent: Mar. 10, 1992

[54] VACUUM SIDE-FOLDER SECTION FOR ENVELOPE BLANK FOLDING APPARATUS

[75] Inventors: Elliot S. Smithe; Ronald G. Himmel, both of Hollidaysburg; Dennis G. Prough, Altoona, all of Pa.

[73] Assignee: F.L. Smithe Machine Company, Inc., Duncansville, Pa.

[21] Appl. No.: 665,015

[22] Filed: Mar. 5, 1991

[51] Int. Cl.[5] ..... B65H 5/08; B65H 5/22; B65H 45/22

[52] U.S. Cl. ..... 493/248; 493/418; 493/438; 493/446; 493/450

[58] Field of Search ..... 493/248, 260, 267, 418, 493/438, 450, 439, 440, 446, 447, 448, 453, 455, 456

[56] References Cited

U.S. PATENT DOCUMENTS 2,785,609 3/1957 Billeb ..... 493/260
3,288,037 11/1966 Burnett ..... 493/248
3,614,914 10/1971 Troll ..... 493/130
4,614,512 9/1986 Capdeboscq ..... 493/413

OTHER PUBLICATIONS

IBM Technical Disclosure Bulletin, vol. 17, No. 4, 9/1974, Water Jet Paper Folder (1098).

*Primary Examiner*—Bruce M. Kisliuk
*Assistant Examiner*—Jack Lavinder
*Attorney, Agent, or Firm*—Stanley J. Price, Jr.

[57] ABSTRACT

An envelope forming apparatus has a vacuum table with apertures through which a vacuum is applied onto the surface of the vacuum table. A series of parallel endless belts move across the vacuum table and transport an envelope blank across the vacuum table. The vacuum through the apertures in the vacuum table holds the blank on the belts as they move across the vacuum table and as the blank is folded by a plowshare folder located relative to the vacuum table. Alternatively, a single wide belt with apertures may be substituted for the series of parallel belts.

4 Claims, 5 Drawing Sheets

VACUUM SIDE-FOLDER SECTION FOR ENVELOPE BLANK FOLDING APPARATUS

BACKGROUND OF THE INVENTION

1. Field of the Invention

This invention relates to an envelope folding machine, and more particularly, to an envelope folding machine for forming envelopes which includes a vacuum table with at least one belt moving across the vacuum table to hold and transport the envelope blank through a folder in the folding apparatus.

2. Description of the Prior Art

In automated envelope forming operations, it is well known to provide a folding machine which includes plowshare type folding mechanisms positioned on the folding machine for folding the envelope blanks along the longitudinal axis of movement of the blank while the blank is controlled and moved past the plowshares by means of rollers. The use of a vacuum to hold and transport envelope blanks in envelope making machines is also well known in the art.

U.S. Pat. No. 1,834,564 discloses a feeding apparatus for drawing blanks from a stack and folding the blanks by means of a roller with apertures connected to a vacuum source.

U.S. Pat. No. 2,037,561 discloses an endless conveyor belt with perforations for receiving instrumentalities wrapped in gauze with free ends of the gauze forming leading and trailing end flaps. A suction nozzle grasps the leading end flap and pulls it over the body of the instrumentality while a blower opposite the suction source blows the gauze upwardly to lift the leading end flap away from the conveyor and toward the suction nozzle. The mechanism is duplicated for acting on the opposite end flap and provision is made for a means to transfer the instrumentalities from one conveyor to another.

U.S. Pat. No. 2,754,113 discloses a sheet folding machine wherein the material to be folded is fed onto two parallel central conveyor belts which raise the material at the sides such that the center section of the material is conveyed beneath a plate. As the material passes beneath the plate it is clamped and the sides are folded over by cross plates. The article is thereafter passed over a cross folding roll above which is positioned an air blast pipe which is operated to send a blast of air against the material and force the material between rolls to provide a crossfold after which it is conveyed to a stacker.

U.S. Pat. No. 2,846,215 discloses a device utilizing rolls with vacuum apertures to grip and fold endless bands of paper.

U.S. Pat. No. 3,685,818 discloses a method for folding diapers on a collapsible suction plate with hinged sections corresponding to the folded portions of the articles to be folded. A pair of suction discharge rolls remove the diapers from the suction plate and transport them to a packaging carton.

U.S. Pat. No. 3,870,292 discloses the use of rolls with apertures connected to a vacuum source to transport and fold a continuous web of paper.

U.S. Pat. No. 4,682,977 discloses an apparatus for folding side flaps inwardly in a continuous web of material. The continuous web is cut by a die roll pair transversely to the longitudinal axis of the web. The web of material is held between a vacuum belt and a friction belt, and the flaps formed by the die roll pair are folded by friction belts at an angle to the longitudinal axis of the material to be folded.

U.S. Pat. No. 4,549,728 disclose a vacuum table having at least one row of apertures which is used to apply a vacuum to a sheet of paper as it approaches a head stop, to slow the paper before it reaches the head stop to prevent wrinkles and inaccurate folds. When the paper reaches the head stop, a chopper folder introduces the paper between two fold rollers turning in opposite directions to fold the paper.

Although the prior art discloses the use of a vacuum to grip and move either a sheet or web of material, as well as a vacuum for slowing the forward advancement of a sheet of material, there remains a need for a vacuum table used in conjunction with a plowshare type folding device to better perform the controlling function of the blank as it passes through the folder area and to simplify the construction of the envelope blank folding apparatus to enable the operator to more easily adjust and maintain the apparatus.

SUMMARY OF THE INVENTION

In accordance with the present invention, there is provided an envelope blank folding apparatus for use in folding blanks into envelopes which includes a vacuum table with apertures, a series of belts or a single perforated belt moving across the vacuum table, and a plowshare folder for folding the envelope blank as it moves across the table and is held on the moving belts by the vacuum through the apertures in the vacuum table.

The front end of the plowshare fits into a groove in a plate that runs transversely to the longitudinal axis of the direction of movement of the blank. This placement of the front end of the plowshare in the groove provides for a smooth transition of the blank from the preceding belts to the vacuum table with the plowshare folding device.

The rear end of the plowshare folding device is held above the belts by a set screw holder which vertically positions the rear end of the plowshare relative to the vacuum table. The set screw holder has an adjustment screw to adjust the height of the rear end of the plowshare to prevent the rear end of the plowshare from abrading the belts on the vacuum table.

The belts carry the blank across the table and into contact with the plowshare folding apparatus. The vacuum applied through the apertures in the table adjacent to the belts causes a suction to be applied through the spaces between the belts to hold the paper onto the belts.

Accordingly, the principal object of the present invention is to provide a plowshare folding apparatus for material that eliminates rollers to increase visibility of and access to the material as it passes through the folder, facilitates adjustment and reduces maintenance requirements on the machine.

These and other objects of the present invention will be more completely disclosed and described in the following specification, the accompanying drawings and the appended claims.

DESCRIPTION OF PREFERRED EMBODIMENT

Figure 1:
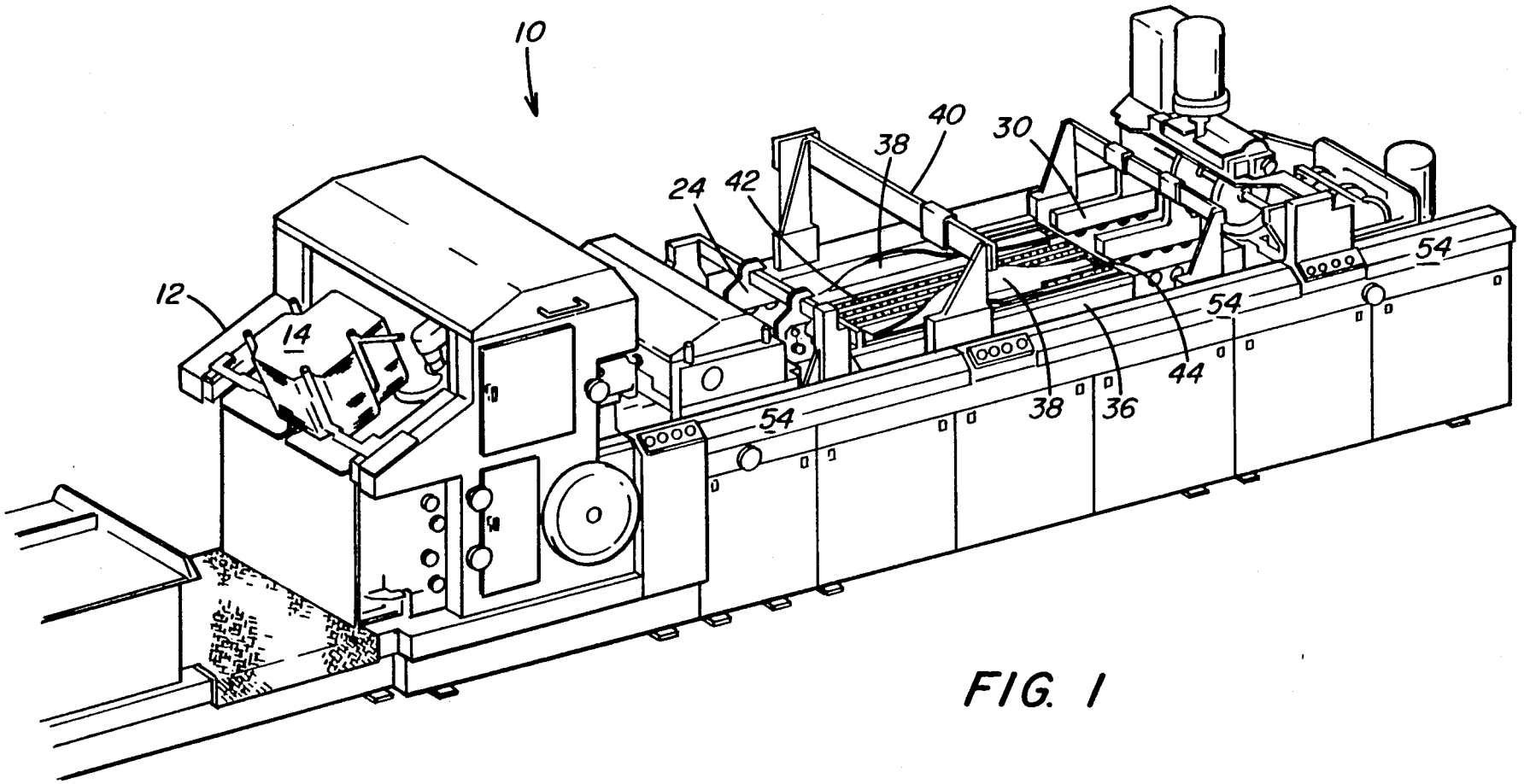
FIG. 1 is a perspective view of the envelope making machine and incorporating the vacuum table with side folders.
Figure 2:
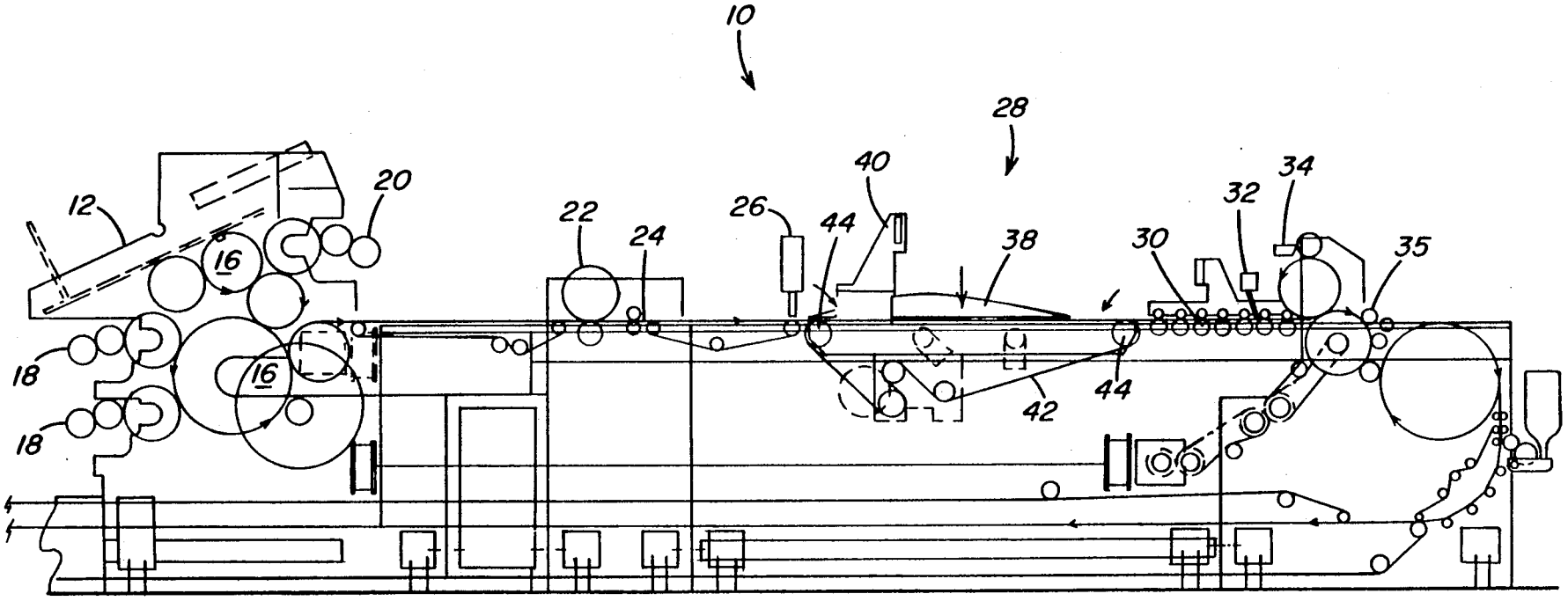
FIG. 2 is a view in side elevation of the envelope making machine and incorporating the vacuum table with a plowshare folder.

Referring to the drawings, and particularly to FIGS. 1 and 2, there is illustrated an envelope forming machine generally designated by the numeral 10 for use in forming envelopes from blanks of paper. Envelope forming machine 10 includes a vacuum feed 12 for transferring the blanks 14 from the stack of blanks to the disk drive and separator mechanism 16. From the disk drive and separator mechanism 16 the blank 14 is moved through envelope forming machine 10 to the outside printers 18 and then to the inside printer 20. Top and bottom score mechanism 22 scores the blank 14, which is then transferred to a side score mechanism 24, and from the side score mechanism 24 the blank 14 is moved to a center seal gummer 26.

From the center seal gummer 26 the blank 14 is transferred to a vacuum table folding device generally designated at 28 which is the object of the present invention and which will be described in greater detail hereinbelow. From the vacuum table folding device 28 the blank 14 is picked up by creasing rollers 30 which crease the folds in the blanks 14 made by the vacuum table folding device 28. A side seam gummer 32 applies glue to the side seams of the blank 14, and a bottom flap gummer 34 applies glue to the bottom flaps of the blanks 14. Bottom flap folder 35 folds the bottom flap of blank 14.

Referring to FIGS. 1 and 2, the vacuum table folding device 28 illustrated is a vacuum table generally designated at 36 with a pair of plowshare folders 38 supported in overlying relation to the vacuum table 36 by means of a beam 40. Belts 42 are driven across the vacuum table 36 to effect movement of blanks 14 across the vacuum table 36 and into contact with the plowshare folders 38. The belts 42 are guided and driven by rollers 44 which are in turn driven by an appropriate drive mechanism.

Figure 3:
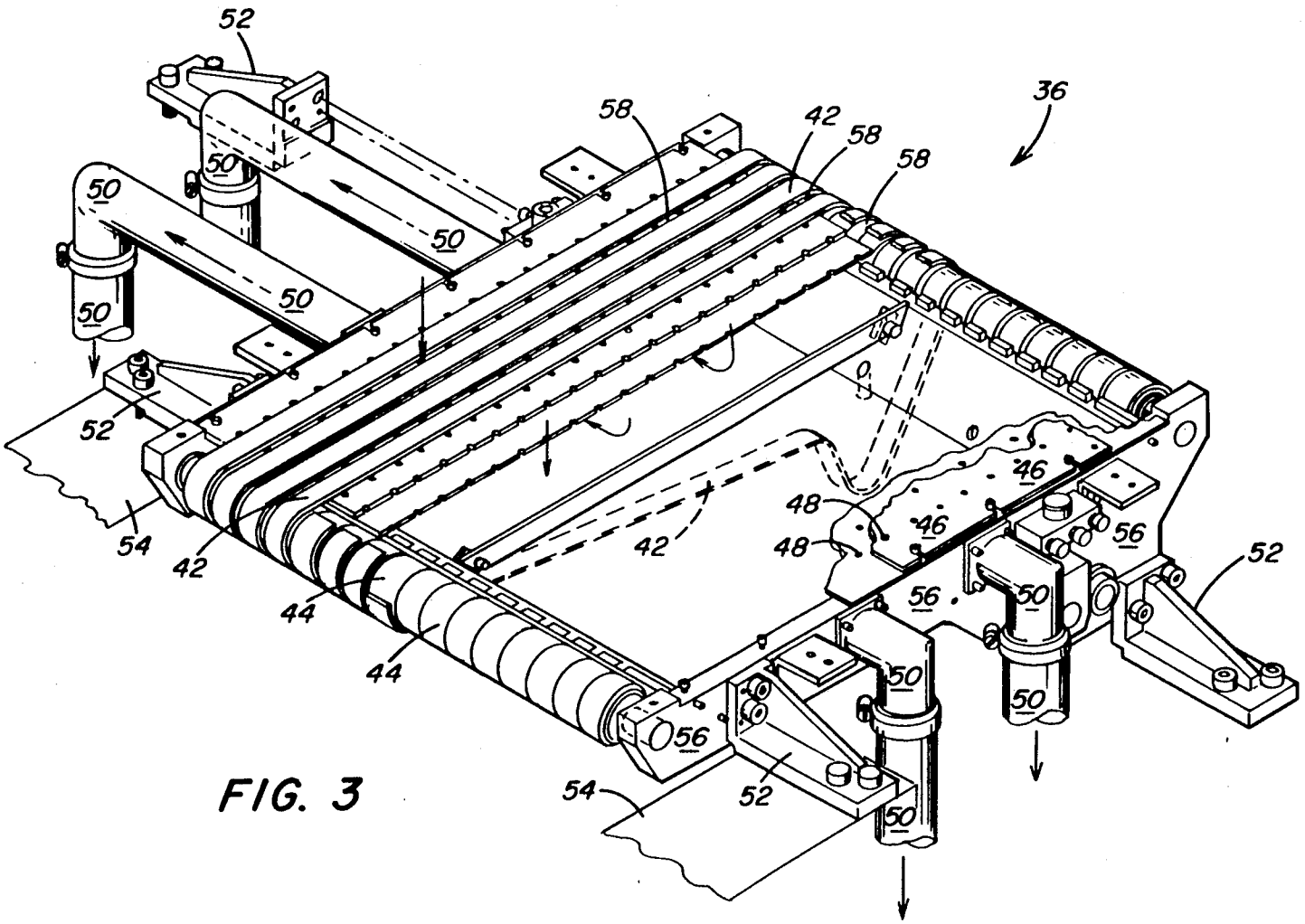
FIG. 3 is a perspective view of a vacuum box with portions broken away to illustrate the features of the vacuum box.

Referring to FIG. 3, which illustrates vacuum table 36 with portions thereof broken away, a plurality of parallel continuous endless belts 42 extend around rollers 44, which are driven by appropriate drive mechanisms. The upper surface 46 of the vacuum table 36 has a plurality of apertures 48 which draw in air as a result of the vacuum created by the evacuation of air from the vacuum box 36 via pipes 50. The pipes 50 are connected vacuum creating mechanism. Vacuum table 36 is connected to the envelope forming machine 10 by means of connecting members 52 which are bolted to the frame 54 of the envelope machine 10 and also bolted to the frame 56 of the vacuum table 36. As the belts 42 are driven across the upper surface 46 of the vacuum table 36, air drawn into the vacuum box 36 through the apertures 48 in the upper surface cause the blanks 14 to adhere to the belts 42 as the air being drawn into the vacuum box 36 must pass through the space 58 between adjacent belts 42.

Figures 4, 5, 6:
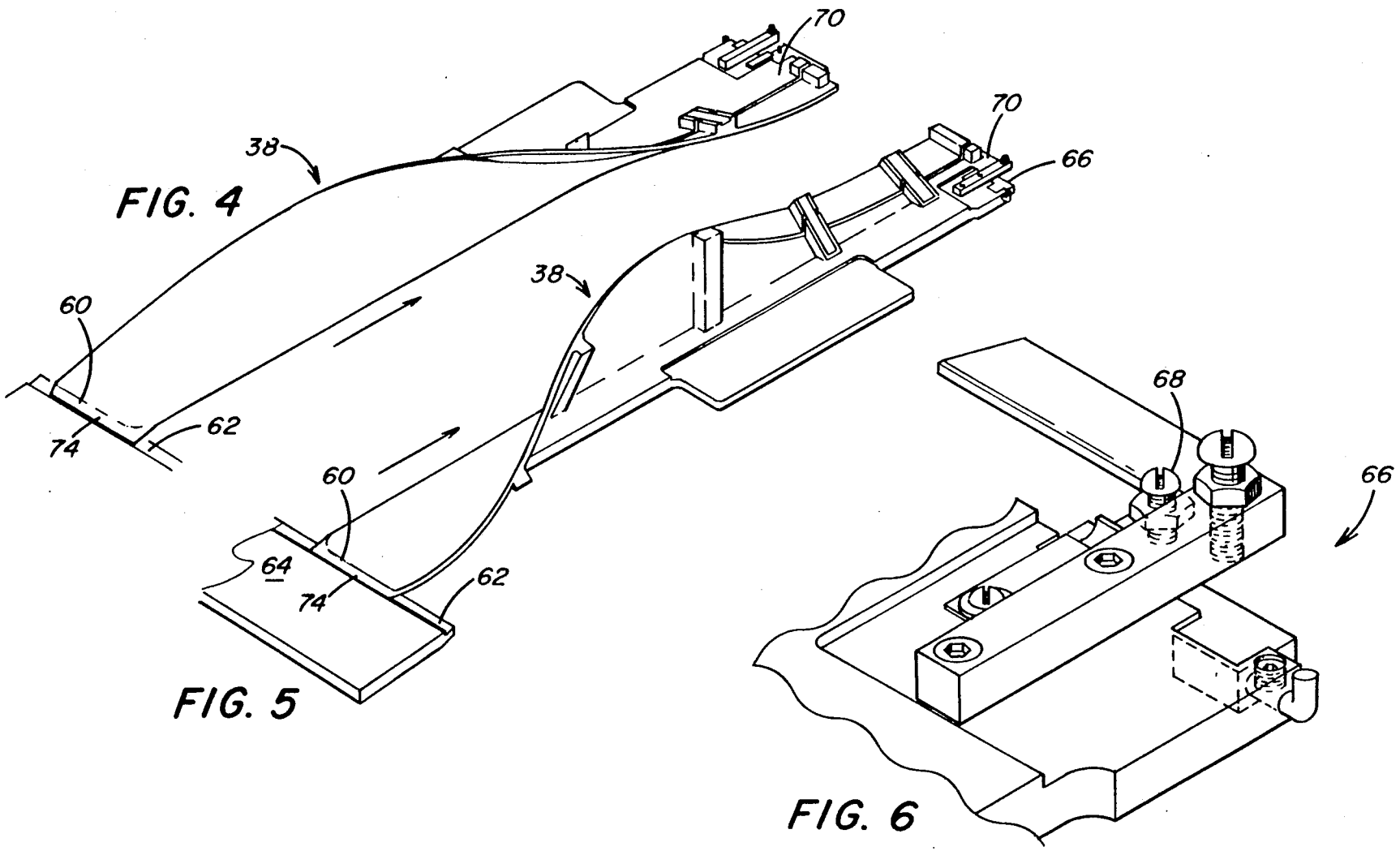
FIG. 4 is a perspective view of the drive side plowshare.
FIG. 5 is a perspective view of the operator side plowshare.
FIG. 6 is a detail of the height adjustment apparatus for the plowshares exit end.

Referring to FIGS. 4 and 5, there is illustrated the plowshare folding device 38 which is located relative to the vacuum table 36 by means of beam 40. The direction of movement of paper on the plowshare folding device 38 is indicated by the arrows, and as the blank 14 moves across the vacuum table 36 on the belts 42, the plowshare folders 38 engage the side flaps of the blank 14 and fold them up and over the main body of the blank 14. The tips or front ends 60 of the plowshares 38 are angled downwardly and fit into recesses 62 in plate 64 which extends transversely to the axis of movement of the blanks 14 across the vacuum table 36, as will be more fully described hereinbelow. The plowshares 38 are a thin wall of rigid material which have at their front end an initially planar surface and which gradually bend toward each other in a 180° turn to engage the ends of the blanks 14 parallel to the axis of movement of the blanks 14 across the vacuum table 36 and to fold the side portions of the blanks 14 over the main body surface of the blanks 14 opposite the vacuum table 36. The rear end 70 of the plowshares 38 are supported on the vacuum table 36 above the belts 42 by means of a height adjustment 66.

As illustrated in FIG. 6, height adjustment clamp 66 has a screw set 68 permitting adjustment of the height of the rear end 70 of the plowshare 38 to prevent the rear end 70 of the plowshare 38 from abrading the belts 42.

Figure 7:
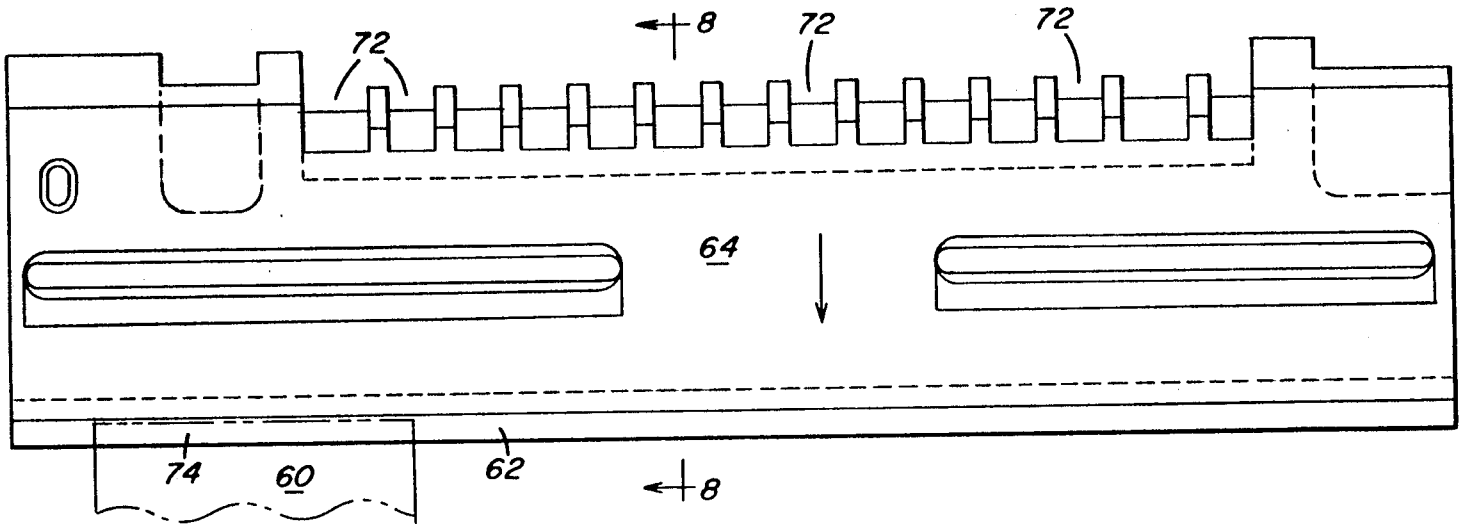
FIG. 7 is a plan view of the table plate at the entry end of the present invention.

FIG. 7 illustrates the plate 64 into which the front ends 60 of the plowshares 38 fit into the recesses 62. Plate 64 has a series of indentations 72 to accommodate the rollers bearing the belts. The front edge of plate 64 slides under the preceding station acting upon blanks 14 to facilitate the smooth transition of the blanks 14 from the preceding station.

Figure 8:
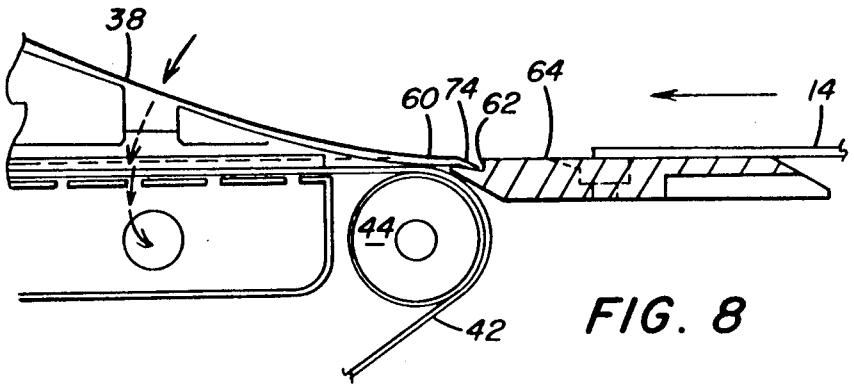
FIG. 8 is a view in section taken along line 8—8 in FIG. 7 and illustrating the table plate receiving the tip of a plowshare in a groove in the table plate.

FIG. 8 is a view of the tip 74 of plowshare 38 fitting into the recess 62 in the plate 64 and the plate 64 receiving a blank 14 from the preceding station.

According to the provisions of the Patent Statutes, we have explained the principal, preferred construction and mode of operation of our invention and have illustrated and described what we now consider to represent its best embodiments. However, it should be understood that within the scope of the appended claims, the invention may be practiced otherwise than as specifically illustrated and described.

We claim:

1. A vacuum table folding apparatus comprising, a vacuum chamber, at least one aperture in a surface of said vacuum chamber, at least one continuous endless belt in overlying relation with said aperture in said vacuum table and said belt having a drive means, and folding means positioned above said belt and arranged to fold an envelope blank as said blank is held on said belt by the vacuum from said vacuum table, in which, said folding means includes a pair of plowshare type folders, a plate transverse to the axis of movement of said belts, said plate having a groove transverse to the axis of movement of said belts, and the tip of each of said plowshares fitting into said groove.

2. The vacuum table folding device as set forth in claim 1 in which, said belt includes at least one aperture for the vacuum to urge said blank into engagement with said belt.

3. The vacuum table folding apparatus as set forth in claim 1 in which, the rear end of each of said plowshares having a means for moving said rear end of at least one of said plowshares toward or away from said belts.

4. The vacuum table folding apparatus as set forth in claim 1 in which, a plurality of said belts are spaced from each other on said vacuum table.

* * * * *